United States Patent [19]

Shen

[11] Patent Number: 4,840,413

[45] Date of Patent: Jun. 20, 1989

[54] LENGTH-ADJUSTABLE LATCH

[76] Inventor: Richard Shen, No. 233, Sec. 2, Hai Tien Road, Tainan, Taiwan

[21] Appl. No.: 85,620

[22] Filed: Aug. 14, 1987

[51] Int. Cl.[4] ..... E05C 1/16

[52] U.S. Cl. ..... 292/337; 292/DIG. 60

[58] Field of Search ..... 292/337, DIG. 60, 169, 292/169.13, 169.22, 169.23

[56] References Cited

U.S. PATENT DOCUMENTS

| | | | |
|---|---|---|---|
| 3,819,214 | 6/1974 | Hart et al. | 292/DIG. 38 X |
| 4,664,433 | 5/1987 | Solovieff | 292/DIG. 60 X |
| 4,718,706 | 1/1988 | Fang | 292/337 |
| 4,729,585 | 3/1988 | Lin | 292/337 |
| 4,729,586 | 3/1988 | Fang | 292/337 |
| 4,736,973 | 4/1988 | Fang | 292/337 |
| 4,752,090 | 6/1988 | Lin | 292/DIG. 60 X |

*Primary Examiner*—Richard E. Moore

*Attorney, Agent, or Firm*—Morton J. Rosenberg

[57] ABSTRACT

A length-adjustable latch having an outer housing and an inner housing. The length of the latch is adjusted by engaging an extension block of the inner housing with either of two positioned holes of the outer housing. A drive linkage connnects to a backset plate by engaging an extension element of the former with a sliding space of the latter. The combination of the drive linkage and the backset plate is encompassed by a spring but with either a trail end of the backset plate or both the rear portions of the backset plate and the drive linkage passing through each longitudinal opening of a slidable plate, the inner housing, an installation seat and the outer housing. Due to the manner of engagement between the inner housing and the outer housing and the corresponding position of the drive linkage and the backset plate, the length of the latch is adjustable, as desired, for a 60 mm (2⅜") backset length or a 700 mm (2¾") backset length .

1 Claim, 2 Drawing Sheets

LENGTH-ADJUSTABLE LATCH

BACKGROUND OF THE INVENTION

The present invention relates to a length-adjustable latch which is mounted within a door and which is adjustable in length to either a 60 mm (2⅜") or a 70 mm (2¾") backset (the length from center of bored hole to door edge).

At present, two standard backset lengths, namely 60 mm (2⅜") and 70 mm (2¾"), are in common use on the market. Thus, the manufacturer has had to produce latches with different backset lengths to meet different backset needs, which has caused confusion or inconvenience when installing or replacing a latch. Furthermore, the structures of such latches: i.e., with different backset lengths, are basically similar. Therefore, to manufacture two types of latches merely to fulfill different backset lengths is troublesome and the cost of manufacturing is unduly increased because of duplication of manufacturing facilities.

To provide a catch which can be applied in more than one backset length and to decrease manufacturing costs, the length-adjustable latch of this invention has been designed and will be described in detail hereinafter.

SUMMARY OF THE INVENTION

Therefore, a primary object of this invention is to provide a simple length-adjustable latch for directly applying in different backset lengths.

Further objects and advantages of this invention will become apparent as the following description proceeds, and the features of novelty which characterize the invention be pointed out with particularity in the claims annexed to and forming a part of this invention.

DETAILED DESCRIPTION OF THE INVENTION

Figure 1:
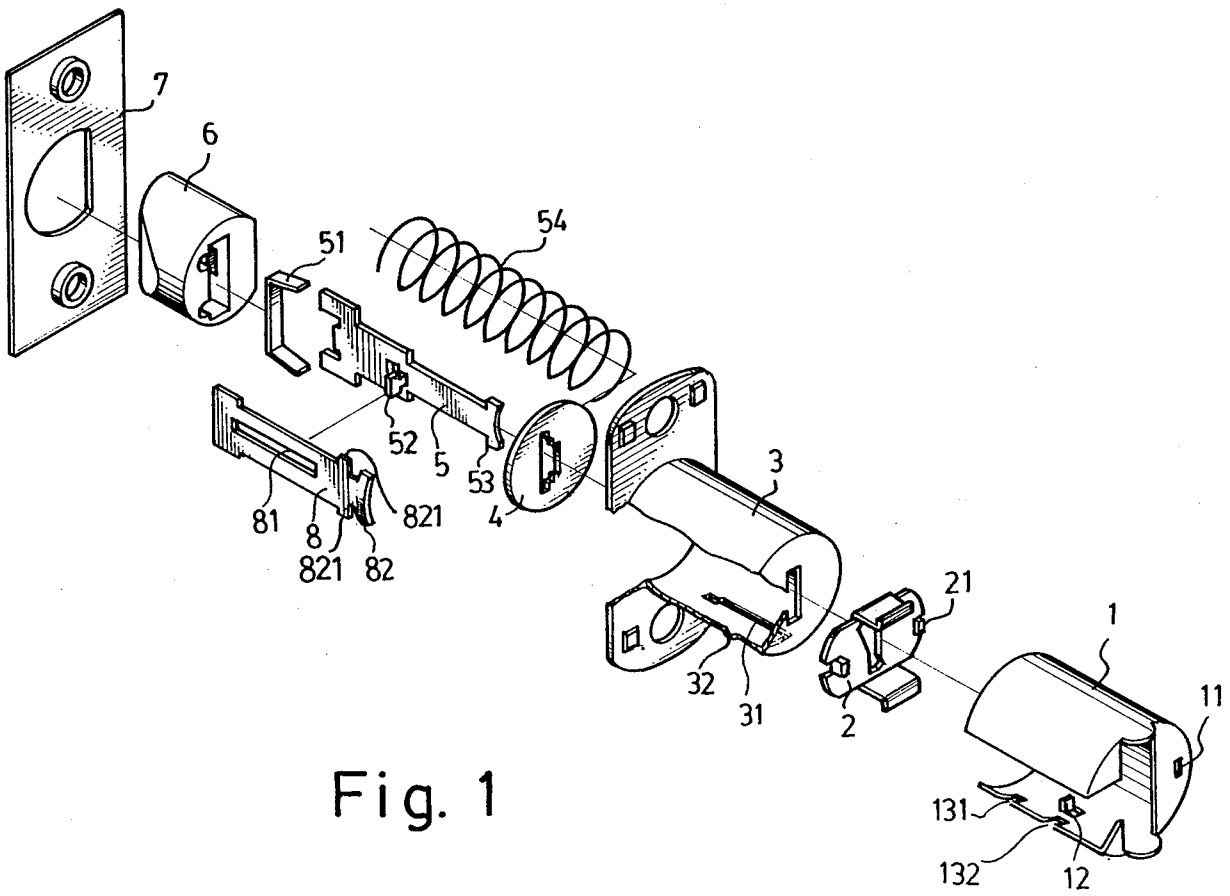
FIG. 1 is an exploded view of the length-adjustable latch for cylindrical lockset of this invention.

With reference now to the drawings, and particularly with reference to FIG. 1, there is shown and illustrated a length-adjustable latch for a cylindrical lockset constructed in accordance with the principles of this invention. The latch comprises an outer housing 1, an installation seat 2, an inner housing 3, a slidable plate 4, a drive linkage 5, a bolt 6, a face plate 7 and a backset plate 8. The outer housing 1, the installation seat 2, the inner housing 3 and the slidable plate 4 each have a longitudinal opening at corresponding positions so that the drive linkage 5 and the backset plate 8 can pass through these openings. Next to the longitudinal opening, the outer housing 1 further comprises two holes 11 on each side of the opening. The installation seat 2 is secured to the outer housing 1 by engaging two blocks 21 thereof with respective corresponding holes 11 disposed at the outer housing 1.

A inwardly-extending protuberance 12, which is engaged with a longitudinal slot 31 disposed on the inner housing 3, is formed on the inner surface of the outer housing 1. Further, the outer housing 1 has two longitudinally-spaced holes 131 and 132 thereon. The holes 131 and 132 are engageable with an extension block 32 for applying in different backset lengths. The different adjustment modes will be described hereinafter with reference to FIGS. 2 and 3.

The circular slidable plate 4 is inserted into the inner housing 3. The drive linkage 5 is a longitudinal plate in which the width is stepped and larger at one end than at the other end. The end with larger width is connected to a U-shaped clip 51 and together inserted into the bolt 6. The other end is formed with an extension 53. The extension element 52 of the drive linkage 5 is slidably received by the longitudinal sliding space 81 of the extension element 8. The drive linkage 5 is stepped at one end thereof to form a larger end and a smaller end. The larger end is connected to a U-shaped clip 51, which in turn is inserted into a bolt 6. The front end of the extension element 52 is slightly larger than the width of the sliding space 81, to prevent the extension element 52 from sliding out of the sliding space 81. Because of the characteristics of the longitudinal sliding space 81, the backset plate 8 is slidably adjustable to different backset length needs.

The extension 53 of the drive linkage 5 and a trail end 82 of the backset plate 8 extend through the longitudinal opening of the slidable plate 4, the inner housing 3 and the installation seat 2. A spring 54 encompasses the drive linkage 5 and the backset plate 8. This spring 54 facilitates the operation of the bolt 6. Please note that the backset plate 8 has a laterally protruding portion 821 formed at the rear end thereof which are blocked by the installation seat 2, thereby preventing the trail end 82 from sliding into the latch and providing for convenient changing of backset lengths.

The backset plate 8 is of course mechanically connected to lockset (not shown). By means of operating the handle, the backset plate 8 or the drive linkage 5 is controlled to draw back the bolt 6, and open the door.

Figure 3:
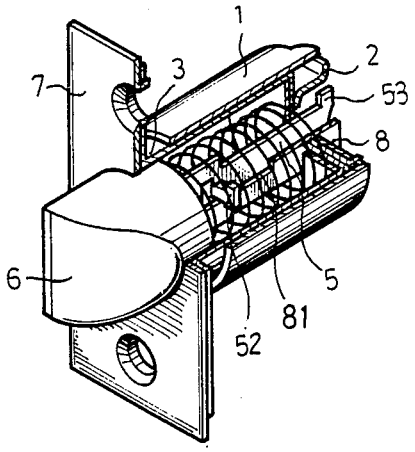
FIG. 3 is a perspective view showing the length-adjustable latch applied in 60 mm backset of lockset.
Figure 2:
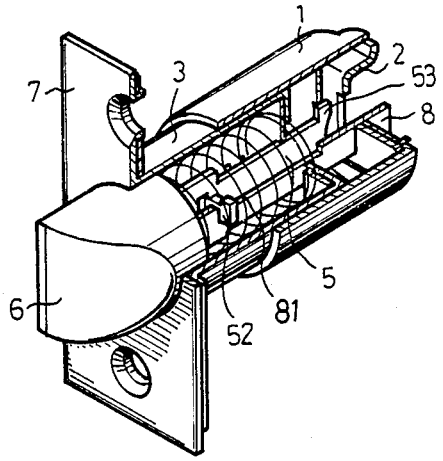
FIG. 2 is a perspective view showing the length-adjustable latch extended to a 70 mm backset.

Now referring to FIG. 2 and 3, working views of the latch of this invention for different backset length needs can be seen. FIG. 2 shows the latch set at a 70 mm (2¾") backset. As shown, the extension block 32 is engaged with the front longitudinally-spaced holes 131 and the drive linkage 5 is concealed in the outer housing 1, while the backset plate 8 is forced to extend out of the outer housing 1 because the protruding portion 821 thereof is trailed by the installation seat 2. To adjust to a 60 mm (2⅜") backset, the extension block 32 is engaged with the rear longitudinally-spaced hole 132 and the protuberance 12 is slid on the front end of the longitudinal recess 31. In this position, the rear portions of both the drive linkage 5 and the backset plate 8 are extended out of the outer housing 1. The above-described two different backset lengths are thus achieved by either extending out the backset plate 8 only or both the backset plate 8 and the drive linkage 5.

Although the invention has hereinabove been described in the presently preferred practice, it will be understood by those having skill in the art that the invention is capable of modification and variation and is limited only by the following claim.

I claim:

1. A length-adjustable latch comprising:

an outer housing (1) having an inwardly-extending protuberance (12) and having two longitudinally spaced holes (131,132) thereon;

an inner housing (3) having a longitudinal slot (31) to engage with said protuberance (12) and having an extension block (32) engageable with said positioned holes (131, 132), a circular slidable plate (4) being inserted thereinto;

an installation seat (2) being secured to said outer housing (1) by engaging two blocks (21) thereof with respective corresponding holes (11) disposed at said outer housing (1);

a drive linkage (5) having an extension element (52) extending from middle portion thereof; said drive linkage (5) being stepped at one end thereof to form a larger end and a smaller end; said larger end being connected to a U-shaped clip (51) and together inserted into a bolt (6); said smaller end being formed with an extension (53);

a backset plate (8) having a longitudinal sliding space (81) to slidably receive said extension element (52) of said drive linkage (5); said extension element (52) having a front end with a width slightly larger a width of said sliding space (81) to prevent said extension element (52) from sliding out of said sliding space (81); said backset plate (8) having a trail end (82) and a laterally protruding portion (821) on a rear end thereof;

a spring (54) encompassing said drive linkage (5) and said backset plate (8) being utilized to facilitate the operation of said bolt (6);

characterized in that:

said outer housing (1) is longitudinally slidable and adjustable relative to said inner housing (3) by positioning said longitudinally-spaced holes (131, 132) with said extension block (32);

said outer housing (1), said installation seat (21), said inner housing (3) and said slidable plate (4) each have respective openings provided on corresponding positions thereof respectively; said extension (53) of said drive linkage (5) extends through said openings provided respectively on the slidable plate (4), the inner housing (3) and the installation seat (2), the protruding portion (821) of the backset plate (8) is blocked out of the outer housing (1) by the installation seat (2);

said trail end (82) and said laterally protruding portion (821) of the backset plate (8) extend out of the installation seat (2), only said backset plate (8) is usable for drawing back said bolt (6) when said outer housing (1) is in a 70 mm backset position; said drive linkage (5) is utilized for drawing back said bolt (6) when said outer housing (1) is in a 60 mm backset position.

* * * * *